US006493979B2

(12) United States Patent
Katzmaier

(10) Patent No.: US 6,493,979 B2
(45) Date of Patent: Dec. 17, 2002

(54) HANDGUN SYSTEM WITH AN EXCHANGEABLE BARREL

(75) Inventor: Wolfgang Katzmaier, Oberndorf (DE)

(73) Assignee: Heckler & Koch GmbH, Oberndorf/Necker (DE)

( * ) Notice: Subject to any disclaimer, the term of this patent is extended or adjusted under 35 U.S.C. 154(b) by 0 days.

(21) Appl. No.: 09/776,192

(22) Filed: Feb. 3, 2001

(65) Prior Publication Data

US 2001/0045045 A1 Nov. 29, 2001

Related U.S. Application Data

(63) Continuation of application No. PCT/EP00/04784, filed on May 25, 2000.

(30) Foreign Application Priority Data

Jun. 4, 1999 (DE) ..... 199 25 676

(51) Int. Cl.[7] ..... F41A 21/12
(52) U.S. Cl. ..... 42/77; 102/439
(58) Field of Search ..... 42/77, 76.01, 78, 42/49.02, 15, 105; 89/14.05; 29/1.1, 1.22, 1.23; 102/439, 444, 464, 481, 467

(56) References Cited

U.S. PATENT DOCUMENTS 3,196,569 A * 7/1965 Thomason
3,339,304 A * 9/1967 Knode, Jr.
3,708,841 A 1/1973 Quinney
4,494,332 A * 1/1985 Matievich
4,648,192 A * 3/1987 Harness
4,729,186 A * 3/1988 Rieger
4,735,009 A * 4/1988 Jett, Jr.
4,969,283 A 11/1990 Baehr
4,989,359 A * 2/1991 Kinkner et al.
5,228,887 A 7/1993 Mayer
5,325,617 A * 7/1994 Vojta et al.
5,410,834 A * 5/1995 Benton et al.
5,463,959 A * 11/1995 Kramer
5,822,904 A * 10/1998 Beal
6,293,040 B1 * 9/2001 Luth
6,293,203 B1 * 9/2001 Alexander
6,295,751 B1 * 10/2001 Piwonski

FOREIGN PATENT DOCUMENTS

DE 4008357 A * 9/1991
EP WO 90/10841 9/1990
GB 2 258 911 2/1993

OTHER PUBLICATIONS

Official Search Report of EPO/ISA from PCT/EP00/04784.

* cited by examiner

*Primary Examiner*—Michael J. Carone
*Assistant Examiner*—Troy Chambers
(74) *Attorney, Agent, or Firm*—Marshall, Gerstein & Borun

(57) ABSTRACT

A system for firing either a first cartridge or a second cartridge from a handgun, the first and second cartridges having dissimilar calibers. The system includes a first barrel removably mounted to the handgun, with the first barrel including a first cartridge chamber sized to permit placement of the first cartridge into the first barrel in a firing position. The first cartridge chamber is sized to prevent placement of the second cartridge into the first cartridge chamber in the firing position. A second barrel is provided, which is interchangeable with the first barrel and which is also removably mounted to the handgun. The second barrel includes a second cartridge chamber sized to permit placement of the second cartridge into the second barrel in a firing position, and the second cartridge chamber is sized to prevent placement of the first cartridge into the second cartridge chamber in the firing position.

19 Claims, 4 Drawing Sheets

HANDGUN SYSTEM WITH AN EXCHANGEABLE BARREL

RELATED APPLICATIONS

This application is a continuation of and claims priority under 35 U.S.C. § 120 from PCT Application Ser. No. PCT/EP00/04784, filed May 25, 2000.

FIELD OF INVENTION

The invention generally relates to a firearm system for a handgun which possesses an exchangeable barrel with a cartridge chamber and a breech.

BACKGROUND OF THE INVENTION

In these documents, when reference is given to position, the assumption is of a normal model of a handgun in a horizontal position, and "forward" is in the direction of shooting.

If a silenced weapon is to truly function without sound, the expansion noise of the gases which drive the bullet and the sound of the cartridge detonation must be suppressed. A third sound produced by the fired bullet will last as long as the bullet travels at supersonic velocity. For the suppression of the sound of the bullet, it is possible to choose cartridges, such that the velocity of the bullets is initially subsonic. Alternatively, one can excise gas relief passages in the barrel, which divert a portion of the driving gases into a silencer, and assure that the velocity of the bullet in flight does not exceed the supersonic level. This diversion of gas is only a reasonable measure when the nominal muzzle velocity of the bullet does not exceed the supersonic border. Finally, it is also possible to make use of special, somewhat experimentally made cartridges, the bullets of which do not attain supersonic velocities.

Since the 1960's, the caliber of military weapons has become steadily smaller. In the second world war, a caliber of 6.5 mm (Italy, Japan, Sweden) was generally seen as being too small to be effective as a military bullet. The average caliber was between 7.5 to 8 mm at that time.

Today, the modern NATO caliber is set at only 5.56 mm (0.223 Remington). In the former Soviet Union, an effort was made to reduce caliber still further, striving for approximately 4.5 mm.

The bullet of a 0.223 cartridge weighs about 3.5 g. In order to maintain a sufficient energy at muzzle, the muzzle velocity of the bullet must exceed three times the supersonic level. In any event, the muzzle velocity is closely calculated and must not fall short of the calculated value.

If one would redesign this 0.223 cartridge so that with some reliability, its bullet would travel at a subsonic velocity, one would obtain a muzzle energy, which would run at only a tenth of its original muzzle energy. This would be a muzzle energy appropriate for a small bore weapon with weaker ammunition (subsonic munitions). However, this bullet would scarcely penetrate a notebook, and "bulletproof vest" could offer complete protective cover.

For today's military command organizations, the greatest possible repression of sounds emanating from firing is essential. To achieve such a goal, for the above reasons, no military weaponry can be employed, even when said weapons are equipped with silencers. Namely, either the sound of the firing is not silenced enough, or the effect of the shooting is insufficient. Now, it is entirely possible to make use of a submachine gun with a silencer, when the said gun fires on a closed breech basis and not, as is usual, from an open breech basis. With such a submachine gun, precision shots can be executed. It would be, however, better to employ the conventional military rifle for the use of such a silencer, as this weapon is already commercially available and need not be specially obtained. Further, the marksmen teams are familiar with the conventional weapon.

To accomplish this goal, one can provide the handgun with an exchangeable barrel for a large caliber cartridge. The reason for this, is that the larger caliber indicates a cartridge with a greater bullet weight, and consequently a greater muzzle energy, even in the subsonic velocity range. However, the earlier cited difficulties in military application are substituted for by new problems, namely the danger of erroneous cartridge switch. Here is an historic example:

In the first world war, the Mauser pistol, which already appeared on the market in 1896, was designed for the bottle cartridge 7.63 mm, but was converted to the 9 mm German Ordnance cartridge Parabellum. This conversion occurred only by use of another barrel, wherein however, the barrel for 7.63 mm and 9 mm were fully exchangeable. Other conversions and/or modifications were not necessary. Principally, a characteristic pistol stock became a recognition signal alerting that an exchange had been made.

In fact, inadvertent switches were often made, since either of the cartridges could be loaded into either pistol. If the 9.3 mm pistol were loaded with 7.63 mm cartridges, firing was still possible, but with reduced muzzle energy, accompanied by an erratic trajectory and loading difficulties. In the reverse situation, the 9 mm bullet squeezed itself through the 7.63 bore, and widened the bore, rendering it unuseable. Possibly, the bolts which limited the recoil travel for the breeching deformed as well.

Also, the earlier Mauser-cartridge 8×57 was modified several times, whereby, fundamentally, the cartridge with the smaller caliber (about 7×57) could be loaded into the bore intended for the larger caliber. In this case, the advantage was gained, that no direct damage to the weapon could be brought about. However, the accuracy of the gun, especially the sequential bull's-eye reliability was greatly reduced. If, for instance, the result of a commando raid depended on the results of a shot hitting its mark, then any inefficiency in the aim could not be accepted, especially when error can be attributed to a faulty loading of the weapon.

Based on the foregoing reasons, the disclosed device would provide a handheld firearm system, which would be free of the above difficulties.

SUMMARY OF THE INVENTION

A firearm system for the firing of bottle shaped cartridges from a firearm having an exchangeable barrel with a cartridge chamber and a breech closure, in accordance with the teachings of the present invention comprises an exchangeable barrel, which is designed for a bottle shaped cartridge with an essentially greater caliber than used in the original barrel of the firearm, wherein both cartridges have approximately the same length and same base measurements. The firearm system in accordance with the present invention has the feature that the bullet of the large caliber cartridge is so dimensioned, that if any effort is made to place the large caliber cartridge in the cartridge chamber of the bore for the smaller caliber, the said bullet will seat itself in the area of the cartridge section corresponding to the neck of the smaller cartridge and thereby prevent a complete insertion of the cartridge into the cartridge chamber. Additionally, the cartridge with the small caliber is so dimensioned, that any attempt to put the same into the cartridge chamber of the bore of the larger caliber, will result in its shoulder impinging against the shoulder of that section of the cartridge chamber corresponding to the larger caliber, or it will seat itself in front of this section, with the result that its complete insertion into the said cartridge chamber is prevented.

The shoulder of the large caliber cartridge is set back, in reference to the small caliber cartridge, or the large caliber cartridge exhibits at its shoulder a smaller diameter than does the small caliber cartridge, in other words, the large caliber cartridge is slimmer. The large caliber cartridge is preferably bottle shaped, but can also be slightly conical.

A cartridge that is placed in the wrong chamber will protrude from the non-fit cartridge chamber so far to the rear, that it remains unlatched by the oncoming breech block, and for this reason, the cartridge will not fire. Thus, only one barrel with, if required, a gas cylinder, silencer and munitions need be made available for the conversion of a handgun. These are parts, which, for little expense, can be purchased and kept available in the armory of a company.

The object of the disclosed device will be further explained with the aid of an embodiment presented in the accompanying schematic drawing.

DESCRIPTION OF THE PREFERRED EMBODIMENTS

Figure 1:
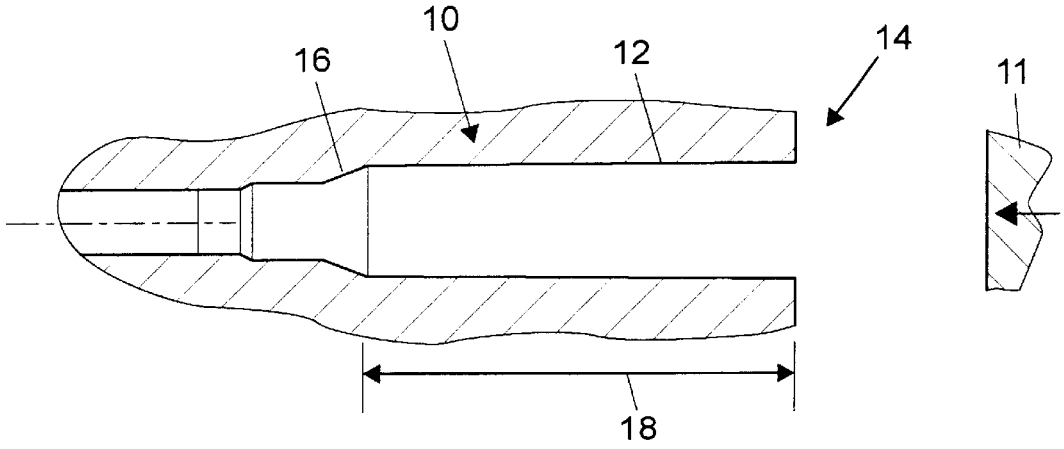
FIG. 1 is an elevational cross sectional view of an exchangeable first barrel and a fragmentary view of a breech.
Figure 2:
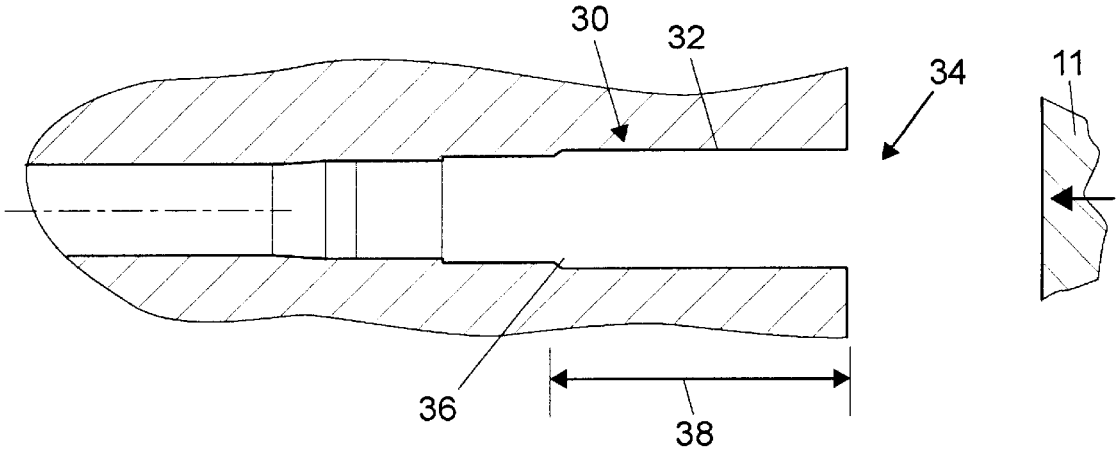
FIG. 2 is an elevational cross sectional view of an exchangeable second barrel and a fragmentary view of a breech.

Referring to FIG. 1, a breech 11 and an exchangeable first barrel 10 are shown. The first barrel 10 has a first cartridge chamber 12, a breech end 14, a shoulder 16, and a first distance 18 defined from the breech end 14 to the shoulder 16. Referring to FIG. 2, a breech 11 and an exchangeable second barrel 30 are shown. The second barrel 30 has a second cartridge chamber 32, a breech end 34, a shoulder 36, and a second distance 38 defined from the breech end 34 to the shoulder 36.

Figure 3:
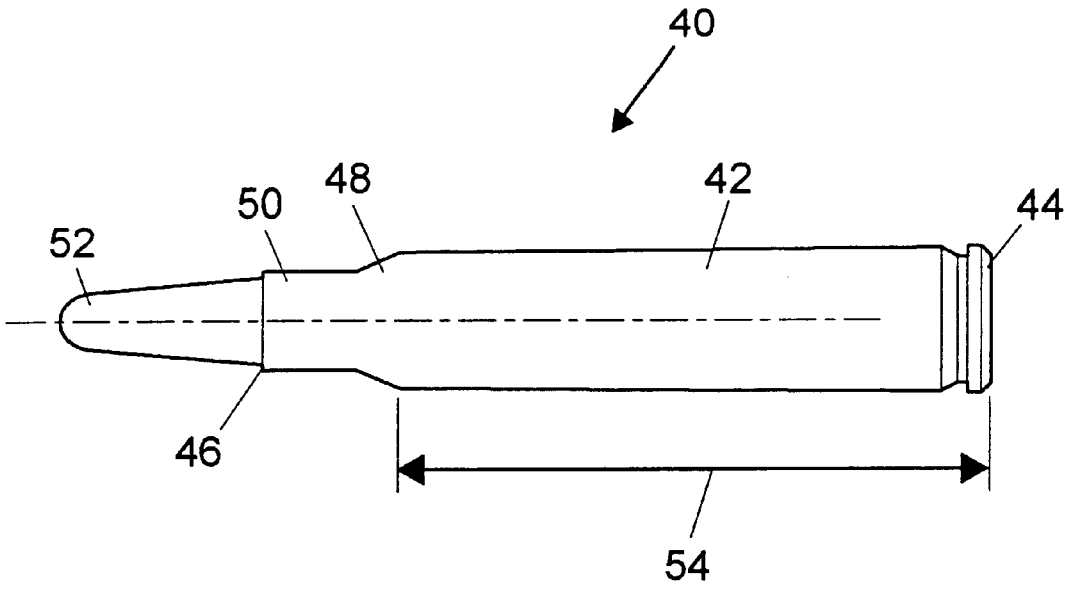
FIG. 3 is a side elevational view of a first cartridge.
Figure 4:
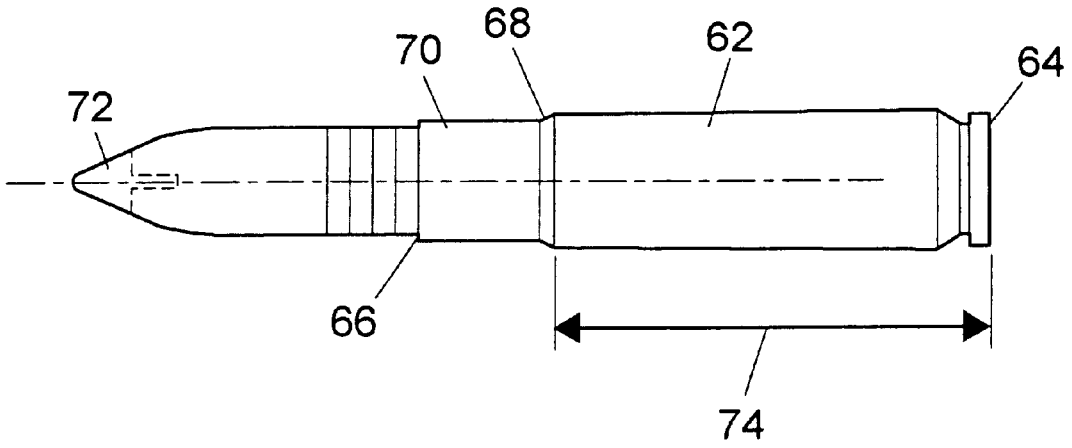
FIG. 4 is a side elevational view of the second cartridge.

Referring to FIG. 3, a first cartridge 40 for use with the first barrel 10 is shown having a cartridge casing 42, a circular base end 44, a circular bullet-receiving end 46, and a shoulder 48 defined by the narrowing of the cartridge casing 42 to a narrowing portion 50. A bullet 52 is attached to the bullet-receiving end 46 of the cartridge casing 42. Referring to FIG. 4, a second cartridge 60, which has a larger caliber than the first cartridge 40, for use with the second barrel 10 is shown having a cartridge casing 62, a circular base end 64, a circular bullet-receiving end 66, and a shoulder 68 defined by the narrowing of the cartridge casing 62 to a narrowing portion 70. A bullet 72 is attached to the bullet-receiving end 66 of the cartridge casing 62.

Figure 5:
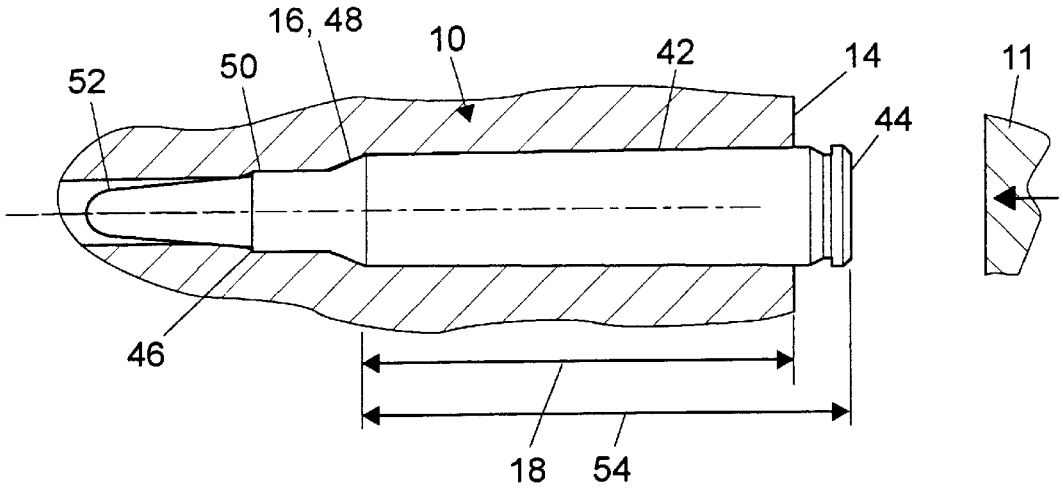
FIG. 5 is the first cartridge of FIG. 3 inserted in the first barrel of FIG. 1.

Referring to FIG. 5, the first barrel 10 is sized to fully receive the first cartridge 40 in the first cartridge chamber 12 for detonation. When the first cartridge 40 is inserted in the first cartridge chamber 12, the shoulder 16 of the first cartridge chamber 12 corresponds to the shoulder 48 of the first cartridge 40.

Figure 6:
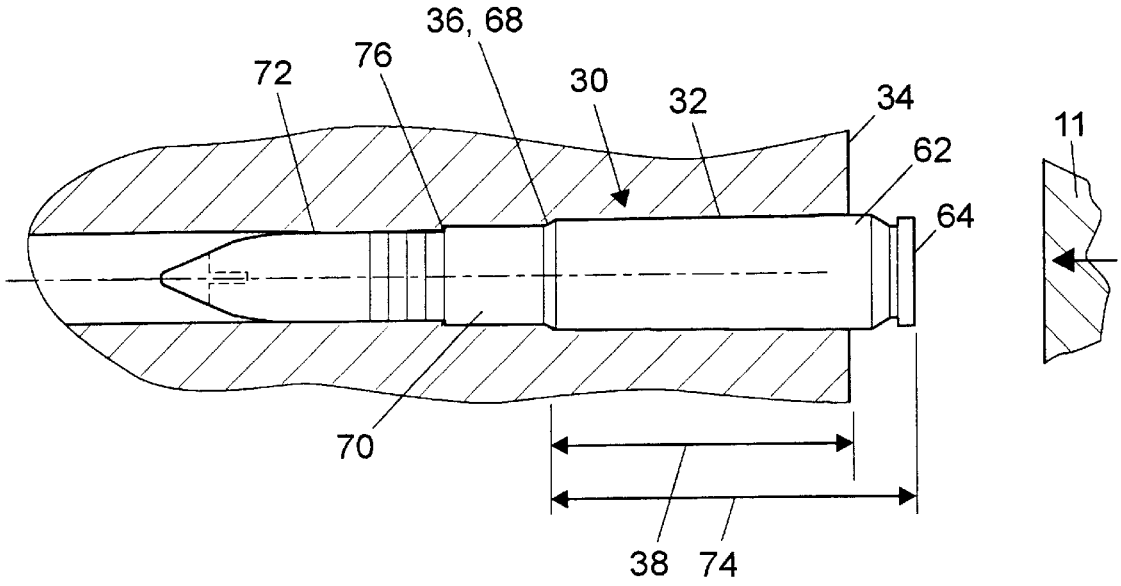
FIG. 6 is the second cartridge of FIG. 4 inserted in the second barrel of FIG. 2.

Referring to FIG. 6, the second barrel 30 is sized to fully receive the second cartridge 60 in the second cartridge chamber 32 for detonation. When the second cartridge 60 is inserted in the second cartridge chamber 32, the shoulder 36 of the second cartridge chamber 32 corresponds to the shoulder 68 of the second cartridge 60.

Both cartridges 30 and 60 have the same overall length. Also, base ends 44 and 64 have the same dimensions. The first cartridge 40 and the second cartridge 60, therefore, can be inserted into identical magazines. The distance 54 between the shoulder 48 and the base end 44 of the first cartridge 40 is longer than the distance 74 between the shoulder 68 and the base end 64 of the second cartridge 60. Therefore, because the bullet 72 of the second cartridge 60 is longer than bullet 52 of the first cartridge 40, the cartridge casing 62 of the second cartridge 60 is shorter than the cartridge casing 42 of the first cartridge 40. Bullet 72 is a larger caliber bullet than bullet 52 and exhibits a substantial length over bullet 52. For example, bullet 72 may have a caliber of 7.62 mm as compared to that of the bullet 52, which may have a caliber of 5.56 mm, and bullet 72 may be between 12–15 g.

Figure 7:
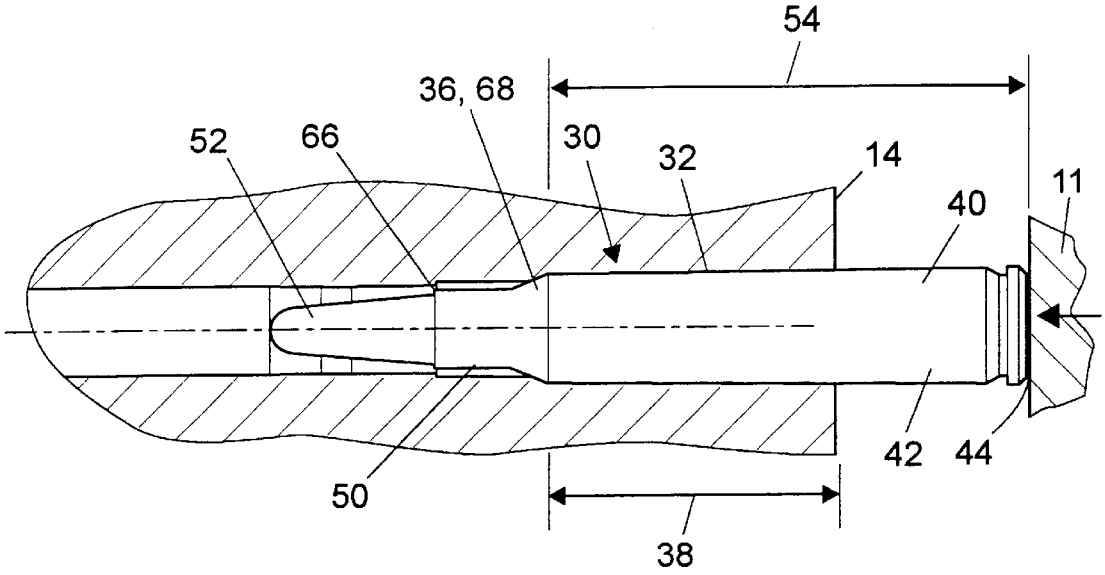
FIG. 7 is the first cartridge of FIG. 3 inserted in the second barrel of FIG. 2.

FIG. 7, shows the cartridge chamber 32 that is intended for the second cartridge 60, but into which, as shown, the wrong cartridge has been introduced, namely the first cartridge 40. The cartridge 40 rests with its shoulder 48 on the shoulder 36 of the second cartridge chamber 32. Because the cartridge shoulder 48 is only appropriate for the cartridge chamber shoulder 16 of the first cartridge chamber 32, base end 44 protrudes out of the breech end 34 of the second barrel 30. Distance 38 of the cartridge chamber 32 is designed to fully receive the bullet 72 for breech closure or locking. Therefore, because the distance 54 of the cartridge casing 42 in longer than the distance 74 of the cartridge casing 62, insertion of the cartridge 40 in the second cartridge chamber 32 results in base end 44 protruding out of the breech end 34 more than that required to close or lock the breech 11. Breech 11, which subsequently attempts to slide the first cartridge 40 into the second cartridge chamber 32, ends its effort with a space between the breech end 34 of the second barrel 30 and the breech 11. This space is greater than the greatest space, as well as the axial closing play, that a closed or locked breech will allow in any case. Therefore, because a firing pin in the breeching can only strike a cartridge upon full closing or locking, no firing can occur.

Figure 8:
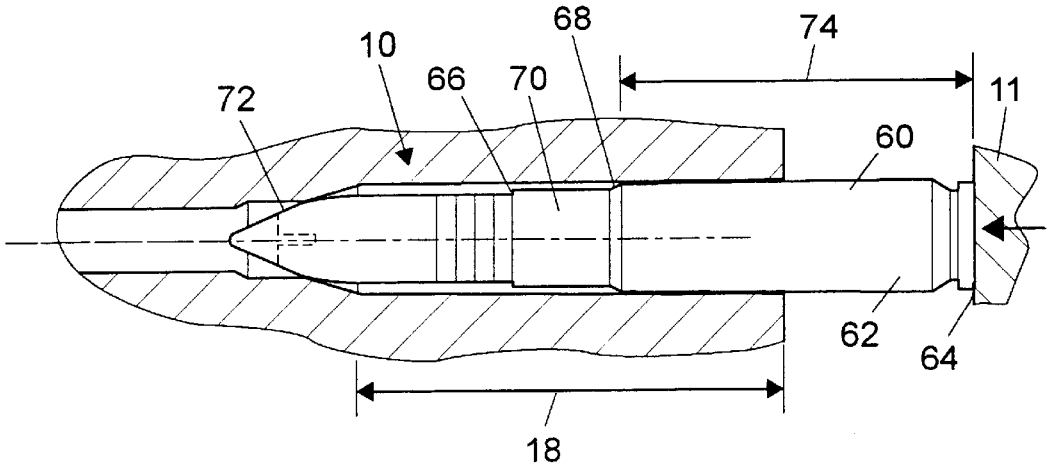
FIG. 8 is the second cartridge of FIG. 4 inserted in the first barrel of FIG. 1.

A reversed situation is shown in FIG. 8, depicting the cartridge chamber 12 for the first cartridge 40, wherein the second cartridge 60 has been inserted. The second cartridge 60, which is a large caliber cartridge, stops with the tip of its bullet 72 at the shoulder 36 of the first cartridge chamber 12. Thus, the base end 64 of the second cartridge 60 protrudes farther out of the breech end 14 of the first cartridge chamber 12 than is permitted by the distance required to close or lock the breech 11. Also in this case, the closure of the breech 11 comes to a stop, before the second cartridge 60 can be detonated.

Non-closure of the breech will be quite visible to a marksman. Therefore, the marksman must then recognize the error of putting the wrong cartridge into the cartridge chamber. This is best done, of course, before an enemy engagement, not while it is going on. DE 41 43 486 C2 has already disclosed a maneuver cartridge barrel, into which a live cartridge simply cannot be inserted. This possibility is not explained in the patent text. The maneuver cartridge can, however, in case of an exchange, be immediately loaded into the live ammunition barrel and also fired therefrom. This is contrary to the disclosed device, wherein a cartridge exchange is immediately recognizable and in no case can switched cartridges be fired.

Thus, a firing of the wrong cartridge, as is possible in the present state of the technology, is excluded.

Preferably, the first cartridge 40 exhibits a bullet 52 with a rounded tip and is furnished with a tombac sheathing. The second cartridge has a pointed bullet 72 which may be formed from a tipped steel core that is centrally inserted in the bullet 72. The steel core prevents the bullet 72 from crumpling up and flattening out when it strikes a target. With the bullet 72 having a steel core, even light armor is still easily penetrable, in contrast to the conventional fully encased bullet of the same caliber and the same hitting power, but lacking the steel core.

The disclosed device, thus makes it possible to employ a modern, small caliber, rapid fire rifle in engagements, wherein the use of silencers is required and a suppression of the bullet sound is advantageous. With use of such a disclosed firing system, the hitting power of a submachine gun is achieved, and, because of the construction of the bullet, a decisive improvement is found in the penetrability of the firing.

Naturally, the disclosed device is principally appropriate to handguns, in which the barrel is simple to exchange. However the invented system can still be applied, although the barrel exchange meets with more complexities, in cases where a number of other weapons are rebuilt for long continuous usage or are so equipped from the start for the large caliber cartridges.

In large caliber cartridges, the shoulder, compared to that of the small caliber cartridges, is shortened to the rear, making the bullet essentially one diameter longer in the forward direction. The result is a very long, and consequently very heavy bullet.

Basing considerations on the fact that the larger caliber is about 2 mm larger than is the smaller, the conclusion must be drawn that the bullet weight is almost exactly four times the weight of the smaller caliber bullet. If this bullet is brought just barely into the subsonic range, then some 35 to 40% of the muzzle energy of the small caliber bullet is surrendered. This matches the muzzle energy of a heavy revolver. A bullet proof vest offers no protection from a direct hit by such a bullet.

For small caliber cartridges of the above mentioned kind, there exist repeating military rifles. Among these are, for instance, the sniper weapons of the East Germany. Such a weapon could be equipped with a changeable original barrel as well as an exchange barrel for large caliber cartridges and be further fitted with a silencer.

Preference is given, however, to a weapon system for use with the disclosed device, which includes a handgun designed with a gas pressure loader, and with which the bore is provided with a gas removal device (for instance, gas boring, cylinder for gas piston).

The existing barrel and the exchange barrel have their respective gas removal devices, thus the barrels are easily exchangeable. Accordingly, consideration has been given to the lessened gas pressure and altered gas pressure in the large caliber bore, by which the bullet is accelerated just barely under the supersonic level.

Moreover, the handgun for use with the disclosed device, is preferably designed as a rapid fire weapon, which as a standard weapon of a soldier is especially suited for commando task forces. The exchange of a barrel in a rapid-fire weapon does not bring about any significant weapon alteration procedures. The large caliber cartridges have the same length and the same base dimensions as the small caliber cartridges, the magazine remains unchanged, and all service elements and hand grips remain unchanged. Under certain circumstances it is advantageous to employ a modified visual sight, since the ballistics of the large caliber cartridges vary strongly from the ballistics of the small caliber cartridges.

The large caliber cartridge, can be a bottle shaped cartridge with a scarcely perceptible neck, or even a conically tapered cartridge without any neck. Essentially, especially in the latter case, the cone apex angle of the large caliber cartridge shell is larger than that of the small caliber cartridge shell. Thus, if the small caliber cartridge is erroneously placed in the cartridge chamber for the large caliber cartridge, it will not permit itself to be completely inserted. Where the large caliber cartridge is concerned, one should strive for a bullet with the greatest possible weight and, accordingly, the greatest possible caliber. In that effort, compromises may be made if a silencer or the like is already at hand, the caliber of which is somewhat smaller than the largest possible caliber which might have been obtained for the large caliber cartridge.

Such a large caliber bullet, because of its correspondingly large cross-section, has only a moderate penetration power. However, the said large bullet has a very high retention power on a living body, because the bullet transfers its entire kinetic energy to the said body.

Thus, a subsonic cartridge, in accord with the disclosed device, penetrates a "bulletproof vest" with a conventional 7.62 mm bullet. However, against the improved body protection favored now by NATO, which is made of 1.2 mm titanium sheet metal and 20 layers of Aramid fiber material (Kevlar), the said bullet is no longer effective, because it collapses or mushrooms against the titanium sheet metal. Further, against the said improved protection, the considerable cross section of the material is not fully penetrated but only tears and the bullet is retained by the Aramid fiber layer or slowed to the point of loss of effectiveness.

In order to overcome this disadvantage, in accord with the disclosed device, the bullet of the large caliber cartridge is a pointed bullet, even though, such a bullet as compared to a blunted or softly rounded bullet has a lesser weight. With the sharpened point, upon impact, the point brings against the titanium so high a loading per cross-sectional area, that a small area penetration can be made. Subsequently, the pressure of the remaining body of the bullet in a forward direction, splits the penetrated point apart with little loss in energy. Even the Aramid fibers do not need to be separated over the entire cross-section of the bullet, but are pressed randomly and with little energy expenditure away from one another by the pointed bullet tip.

To penetrate the Aramid fiber layers, a core is placed in the bullet, which forms the said point and which is made of tungsten carbide or preferentially, steel. Such a point remains practically undeformed upon striking titanium sheet and separates the Aramid fibers without difficulty.

It will be understood that the above description does not limit the invention to the above-given details. It is contemplated that various modifications and substitutions can be made without departing from the spirit and scope of the following claims.

What is claimed is:

1. A system for firing either a first cartridge or a second cartridge from a handgun, the first and second cartridges having dissimilar calibers and dissimilar shoulders, the system comprising:

a first barrel removably mounted to the handgun, the first barrel including a first cartridge chamber, the first cartridge chamber having a narrowing shoulder sized and positioned to receive the shoulder of the first cartridge so as to permit placement of the first cartridge into the first barrel in a firing position, the narrowing shoulder of the first cartridge chamber further being sized and positioned to engage a portion of the second cartridge so as to prevent placement of the second cartridge into the first cartridge chamber in the firing position; and a second barrel removably mounted to the handgun, the second barrel including a second cartridge chamber including a narrowing shoulder sized and positioned to receive the shoulder of the second cartridge so as to permit placement of the second cartridge into the second barrel in a firing position, the narrowing shoulder of the second cartridge chamber further being sized and positioned to engage a portion of the first cartridge so as to prevent placement of the first cartridge into the second cartridge chamber in the firing position.

2. A system for firing either a first cartridge or a second cartridge from a handgun, the first and second cartridges having dissimilar calibers, each of the first and second cartridges further having a circular base end, a circular bullet-receiving end, and an interconnecting casing, the casing of each of the first and second cartridges further including a narrowing shoulder disposed between the base end and the bullet-receiving end, the system comprising:

a first barrel removably mounted to the handgun, the first barrel including a first cartridge chamber sized to permit placement of the first cartridge into the first barrel in a firing position, the first cartridge chamber further being sized to prevent placement of the second cartridge into the first cartridge chamber in the firing position; and a second barrel removably mounted to the handgun, the second barrel including a second cartridge chamber sized to permit placement of the second cartridge into the second barrel in a firing position, the second cartridge chamber further being sized to prevent placement of the first cartridge into the second cartridge chamber in the firing position;

and further wherein:

each of the first and second barrels include a breech end, each of the first and second cartridge chambers including a shoulder spaced away from the breech end, the shoulder of the first cartridge chamber being located a first distance from the breech end of the first barrel, the shoulder of the second cartridge chamber being located a second distance from the breech end of the second barrel; and wherein the shoulder of the first cartridge chamber is sized and positioned to receive the narrowing shoulder of the first cartridge when the first cartridge is in the firing position, and further wherein the shoulder of the second cartridge chamber is sized and positioned to receive the narrowing shoulder of the second cartridge when the second cartridge is in the firing position.

3. The system of claim 2, wherein a diameter of the first cartridge chamber adjacent the breech end of the first barrel is equal to a diameter of the second cartridge chamber adjacent to the breech end of the second barrel, and wherein the first distance is greater than the second distance.

4. The system of claim 3, each of the first and second cartridges having a bullet, and wherein:

the second cartridge chamber includes a narrowed portion, the narrowed portion of the of the second cartridge chamber having a diameter smaller than a diameter of a bullet of the second cartridge.

5. The system of claim 2, wherein the shoulder of the first cartridge chamber and the shoulder of the second cartridge chamber are conical.

6. The system of claim 2, wherein the shoulder of at least one of the first cartridge chamber and the second cartridge chamber is conical.

7. The system of claim 1, the first and second cartridges each having a circular base end, a circular bullet-receiving end, and an interconnecting casing, each casing including a narrowing shoulder disposed between the base end and the bullet-receiving end, and wherein:

the handgun includes a breech, the breech shiftable between an open position and a closed position;

each of the first and second barrels including a breech end, the breech end operatively engaging the breech when the breech is in the closed position, the shoulder of the first cartridge chamber being located a first distance from the breech end of the first barrel, the shoulder of the second cartridge chamber being located a second distance from the breech end of the second barrel; and whereby the shoulder of the first cartridge chamber receives the shoulder of the first cartridge, thereby permitting the breech to shift to the closed position, and further whereby the shoulder of the second cartridge chamber receives the shoulder of the second cartridge, thereby permitting the breech to shift to the closed position.

8. A firearm system for a handgun comprising:

a shiftable breech;

a first barrel and a second barrel interchangeably mountable to the handgun;

a first cartridge having a first caliber bullet and a narrowing shoulder disposed a first distance from a base of the first cartridge;

a second cartridge having a second caliber bullet larger than the first caliber bullet and having a narrowing shoulder disposed a second distance from a base of the second cartridge;

the first barrel including a first cartridge chamber, the first cartridge chamber having a shoulder arranged to to permit placement of the first cartridge into the first barrel in a firing position, the shoulder of the first cartridge chamber further arranged to prevent full placement of the second cartridge into the first barrel in a firing position; and the second barrel including a second cartridge chamber adapted to permit placement of the second cartridge into the second barrel in a firing position, the second cartridge chamber further being sized and positioned to prevent full placement of the first cartridge into the second barrel in a firing position.

9. A firearm system for a handgun comprising:

a shiftable breech;

a first cartridge and a second cartridge having dissimilar calibers;

a first barrel and a second barrel interchangeably mounted to the handgun, the first barrel including a first cartridge chamber sized to permit placement of the first cartridge into the first barrel in a firing position, the first cartridge chamber further sized to prevent full placement of the second cartridge into the first cartridge chamber, the second barrel including a second cartridge chamber sized to permit placement of the second cartridge into the second barrel in a firing position, the second cartridge chamber further sized to prevent full placement of the first cartridge into the second cartridge chamber; and the first and second cartridges each having a circular base end, a circular bullet-receiving end, and an interconnecting casing, each casing including a narrowing shoulder disposed between the base end and the bullet-receiving end;

each of the first and second barrels including a breech end, the first cartridge chamber including a shoulder spaced a first distance away from the breech end of the first barrel, the second cartridge chamber including a shoulder spaced a second distance away from the breech end of the second barrel;

the shoulder of the first cartridge chamber receiving the shoulder of the first cartridge when the first cartridge is in the firing position, the shoulder of the second cartridge chamber receiving the shoulder of the second cartridge when the second cartridge is in the firing position.

10. The system of claim 9, wherein a diameter of the first cartridge chamber adjacent the breech end of the first barrel is equal to a diameter of the second cartridge chamber adjacent to the breech end of the second barrel.

11. The system of claim 9, wherein the first distance is greater than the second distance.

12. The system of claim 9, wherein the first and second cartridges each includes a bullet, and wherein the second cartridge chamber includes a narrowed portion, the narrowed portion of the second cartridge chamber having a diameter smaller than a diameter of the bullet of the second cartridge.

13. The system of claim 9, wherein the shoulder of the first cartridge chamber and the shoulder of the second cartridge chamber are conical.

14. The system of claim 9, wherein the shoulder of the first cartridge and the shoulder of the second cartridge are tapered.

15. The system of claim 12, wherein the bullet of the second cartridge is a pointed bullet.

16. The system of claim 15, the bullet having a tip and a core made from a hard metal.

17. The system of claim 16, wherein the hard metal is steel.

18. A system for firing either a first cartridge or a second cartridge from a handgun comprising:

a first and a second cartridge having dissimilar calibers;

a breech shiftable between an open position and a closed operational position;

a first barrel removably mounted to the handgun, the first barrel including a first cartridge chamber;

a second barrel removably mounted to the handgun, the second barrel including a second cartridge chamber;

means defined in part by cooperating portions of the first barrel and the second cartridge for preventing closure of the breech when the second cartridge is placed in the first cartridge chamber; and means defined in part by cooperating portions of the second barrel and the first cartridge for preventing closure of the breech when the first cartridge is placed in the second cartridge chamber.

19. A system for firing either a first cartridge or a second cartridge from a firearm comprising:

a first and a second cartridge having dissimilar calibers;

a breech shiftable between an open position and a closed operational position;

a first barrel removably mounted to the handgun, the first barrel including a first cartridge chamber;

a second barrel removably mounted to the handgun, the second barrel including a second cartridge chamber;

the first cartridge chamber being shaped and sized to cooperate with portions of the second cartridge to prevent closure of the breech when the second cartridge is placed in the first cartridge chamber; and the second cartridge chamber being shaped and sized to cooperate with portions of the first cartridge to prevent closure of the breech when the first cartridge is placed in the second cartridge chamber.

* * * * *